US005915287A

United States Patent [19]

Fox

[11] Patent Number: 5,915,287

[45] Date of Patent: Jun. 22, 1999

[54] HARMONICA WITH THREE DIATONIC HARPS

[76] Inventor: Peter Fox, 7798 Penwood Ct., Lake Worth, Fla. 33467

[21] Appl. No.: 08/928,814

[22] Filed: Sep. 12, 1997

[51] Int. Cl.[6] ..... G10D 7/12

[52] U.S. Cl. ..... 84/377

[58] Field of Search ..... 84/377, 378, 379

[56] References Cited

U.S. PATENT DOCUMENTS

| | | | |
|---|---|---|---|
| D. 36,748 | 1/1904 | Hohner . | |
| 368,789 | 8/1887 | Smith . | |
| 872,083 | 11/1907 | Reidy . | |
| 1,518,257 | 12/1924 | Dusinberre . | |
| 1,623,175 | 4/1927 | Friedel . | |
| 1,884,150 | 10/1932 | Numberg . | |
| 2,179,993 | 11/1939 | Davies . | |
| 2,256,682 | 9/1941 | Machino | 84/377 |
| 2,276,501 | 3/1942 | Manieri | 84/377 |
| 2,473,210 | 6/1949 | Magnus . | |
| 2,718,808 | 9/1955 | Magnus . | |
| 3,149,527 | 9/1964 | Kraft | 84/377 |
| 3,580,125 | 5/1971 | Heatwole | 84/377 |
| 3,757,025 | 9/1973 | Huang | 84/377 |
| 4,237,766 | 12/1980 | Marshall | 84/377 |
| 4,713,999 | 12/1987 | Burt | 84/379 |

FOREIGN PATENT DOCUMENTS

| | | |
|---|---|---|
| 802306 | 2/1951 | Germany . |

*Primary Examiner*—William M. Shoop, Jr.
*Assistant Examiner*—Wesley Scott Ashton
*Attorney, Agent, or Firm*—Tom Hamill, Jr.

[57] ABSTRACT

A harmonica is provided with three diatonic reed harps vertically aligned in a single housing. The three diatonic reed harps are in communication with a central mouthpiece. The reed harps are in different keys. Two movable sliders block the air channel to two of the three reed harps at any one time. The sliders are caused to move to blocking or unblocking positions through the actuation of a pair of buttons. The first button and the second button engage and disengage elongated slide members which are aligned in horizontal relation with each of the three diatonic reeds, either blocking or unblocking the air passage therethrough, thus preventing their ability to make sound. Through manipulation of the pair of buttons, the user may select any one of three harps to play. When both buttons are disengaged, the central harp is open, and the top and bottom harps are blocked. When the front button is engaged, the lower harp is open, and the top and middle harps are blocked. When the rear button is engaged, the top harp is open, and the middle and bottom harps are blocked. This arrangement permits the performer to play in any one of three keys during a performance while employing a single harmonica.

14 Claims, 4 Drawing Sheets

HARMONICA WITH THREE DIATONIC HARPS

BACKGROUND OF THE INVENTION

1. Field of the Invention

The present invention relates generally to harmonicas, and more particularly, to a harmonica including three diatonic reed harps. The harmonica is especially adapted to permit the selective engagement of any one of the reed harps permitting the performer to selectively play the harmonica in three different keys.

2. Description of the Prior Art

It is known to place two different harmonicas together by mechanical devices. One such device is U.S. Pat. No. 4,713,999 issued to Burt which discloses such a dual harmonica array. This device includes an upper rear harmonica and a lower front harmonica combined with means to keep the two harmonicas in a spaced, substantially parallel, asymmetric relationship. There are also means to rapidly reverse the relationship of the harmonicas. This arrangement permits the performer to separately play each harmonica, as well as switch the two devices.

It is also known to employ a shiftable slide in a harmonica for the purpose of occluding the passage of air through a chamber. One such device is U.S. Pat. No. 3,757,025 issued to Huang. By actuating a button, a slide mechanism shifts inside the harmonica thus occluding the passage of air to one of the chambers.

Thus, while the foregoing body of prior art indicates it to be well known to use a mechanical holder to mount two different harmonicas for play, as well as a sliding mechanism to channel to airflow into a selected chamber, the provision of three diatonic harps being housed together in a single housing has not contemplated. Nor does the prior art described above teach or suggest a single mouthpiece which is in communication with the three diatonic harps. The prior art also does not show a dual button arrangement designed to selectively channel the air into any of the diatonic reeds, permitting the performer to employ one instrument to selectively play in any one of three different keys.

SUMMARY OF THE INVENTION

To achieve the foregoing and other advantages, the present invention, briefly described, provides a harmonica with three diatonic reed harps vertically aligned atop each other in a single housing. The three diatonic reed harps are in communication with a central mouthpiece. The reed harps are in different keys. Two movable sliders block the air channel to two of the three reed harps at any one time. The sliders are caused to move through the actuation of a pair of buttons. The buttons are provided to cause two sliders to selectively block the air channel to two of the three reed harps at any one time, thus preventing their ability to make sound. This permits the user to select and play any one of the three harps without changing harmonicas during a performance. Through manipulation of the pair of buttons, the user may select any one of three harps to play. When both buttons are disengaged, the central harp is open, and the top and bottom harps are blocked. When the front button is engaged, the lower harp is open, and the top and middle harps are blocked. When the rear button is engaged, the top harp is open, and the middle and bottom harps are blocked. This arrangement permits the performer to play in any one of three keys during a performance while employing a single harmonica.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is an object of the present invention is to provide a harmonica with three diatonic reeds which are vertically aligned in a single housing.

It is still a further object of the present invention is to provide a harmonica with two sliders, the first slider being in oriented about a first and second diatonic harp, blocking the first harp while permitting air to pass through the second harp, or alternatively, blocking the second harp while permitting air to pass through the second harp.

It is still a further object of the present invention to provide a harmonica with two sliders, the second slider being oriented about a second and third diatonic harps, blocking the second harp while permitting air to pass through the third harp, or alternatively, blocking the third harp while permitting air to pass through the second harp, such a configuration permitting the playing of one diatonic reed at a time.

It is still a further object of the present invention to permit both the first slider and the second slider to block and unblock the second harp, permitting air to pass through the second harp only when the first and second slider both unblock the second harp.

Still a further object of the present invention is to provide a harmonica where the sliders may be rapidly and selectively engaged and disengaged permitting a rapid change from the playing of one diatonic reed to another.

It is another object of the present invention to provide a harmonica with three diatonic harps which may be easily and efficiently manufactured and marketed.

It is a further objective of the present invention to provide a harmonica with three diatonic harps which is of durable and reliable construction.

An even further object of the present invention is to provide a harmonica with three diatonic harps which is susceptible of a low cost of manufacture with regard to both materials and labor, and which accordingly is then susceptible of low prices of sale to the consuming public, thereby making such a harmonica available to the buying public.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

With reference now to the drawings, a harmonica with three diatonic reeds embodying the principles and concepts of the present invention will be described.

Figure 1:
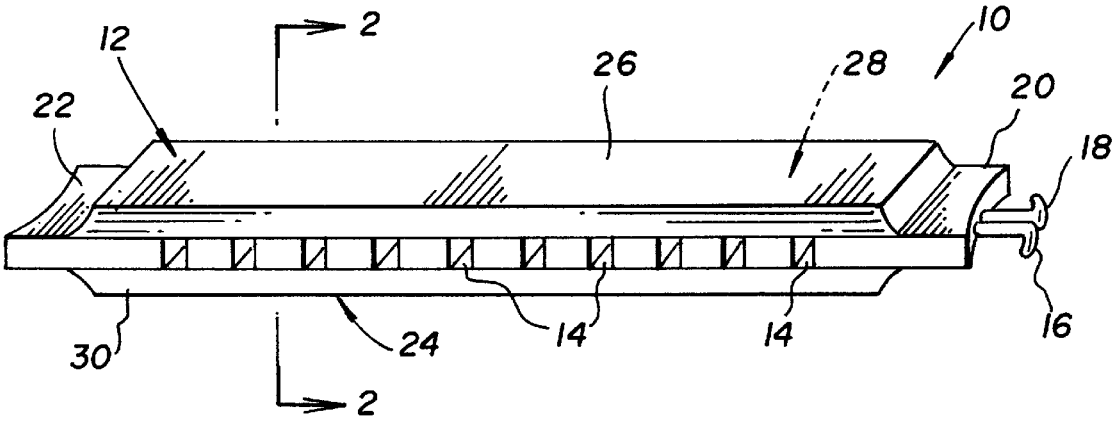
FIG. 1 is a perspective view showing the harmonica with three diatonic reeds of the invention.

Turning initially to FIG. 1, there is shown the harmonica with three diatonic reeds of the invention generally designated by reference numeral 10. In its preferred form, the harmonica 10 comprises a housing 12 which encloses the three diatonic reeds which are in vertical relation. The housing 12 includes a right wall 20, a left wall 22, a bottom wall 24, a top wall 26, a rear wall 28 and a front wall 30. A series of openings 14 are present in the front wall 30 for the performer to blow air through. This air is channeled to a single reed which generates sound. A first button 16 and a second button 18 are located generally on the right side of the harmonica and pass through the right wall 20. The first button 16 and the second button 18 engage and disengage elongated slide members which are aligned in horizontal relation with each of the three diatonic reeds, either blocking or unblocking the air passage therethrough. The specific actuation arrangement will be amplified in the discussion of FIGS. 3–5.

Figure 2:
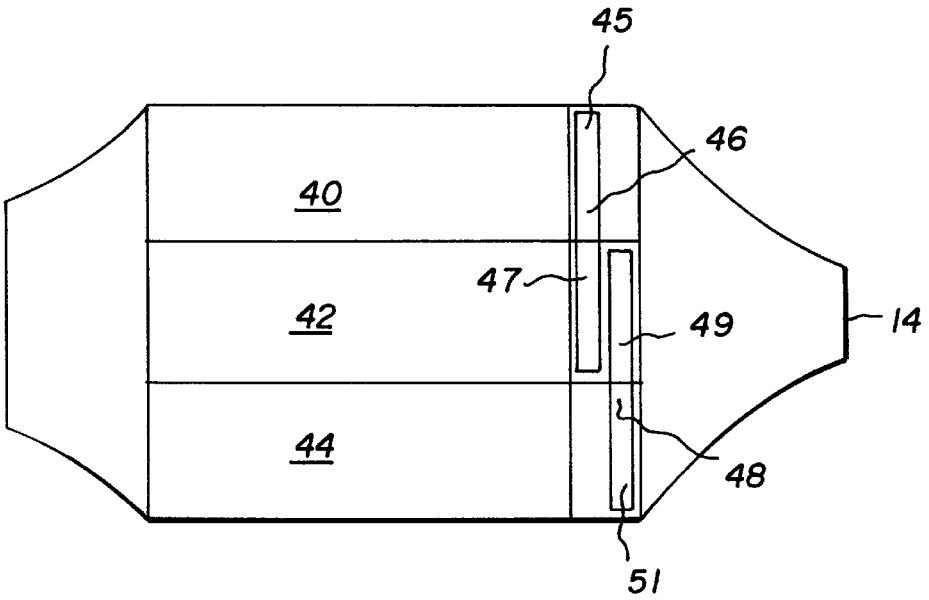
FIG. 2 is a cross-sectional view of the harmonica with three diatonic reeds taken along line 2—2 of FIG. 1.

FIG. 2 is a cut away view of FIG. 1 taken from line 2—2. A first diatonic reed 40 is shown above a second diatonic reed 42 which is shown above a third diatonic reed 44. The diatonic reeds may be in different keys. An arrangement may be as follows, the first diatonic reed 40 may be in the key of G, the second diatonic reed may be in the key of D and the third diatonic key may be in the key of A. It is to be understood that any arrangement or composition of diatonic reeds in different keys may be present.

Element 46 represents a first horizontal sliding mechanism. The first horizontal sliding mechanism 46 is designed to selectively block or permit the air flow to the first diatonic reed 40 and the second diatonic reed 42. Slider 46 includes a first reed 40 blocking means 45 upwardly oriented and a second reed 42 blocking means 47 downwardly oriented. Slider 46 is moved by depressing button 18.

Element 48 represents a second horizontal sliding mechanism, designed to selectively block the air flow to the second diatonic reed 42 and the third diatonic reed 44. Second slider 48 includes a second reed 42 blocking means 49 upwardly oriented and a third reed 44 blocking means 51 downwardly oriented. Slider 48 is moved by depressing button 16.

First slider 46 and second slider 48 are interconnected and in communication with the first button 16 and the second button 18. If first button 16 is in the depressed position, and second button 18 is actuated, first button 16 will return to its neutral or unactuated position and visa versa.

Figure 3:
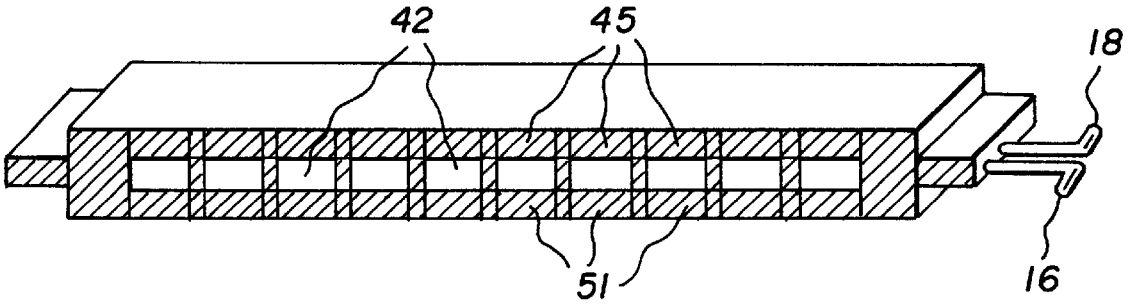
FIG. 3 is a view of the harmonica with three diatonic reeds showing a first slider configuration, where the buttons are in their idle or unpressed condition.
Figure 4:
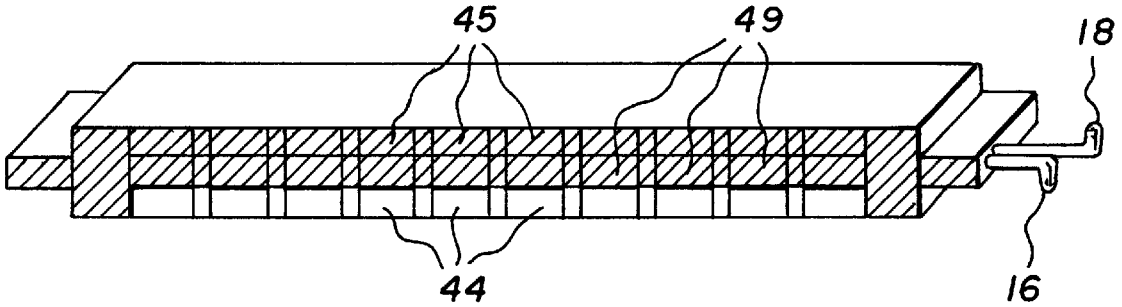
FIG. 4 is a view of the harmonica with three diatonic reeds showing a second slider configuration, where the first button is in the depressed condition.
Figure 5:
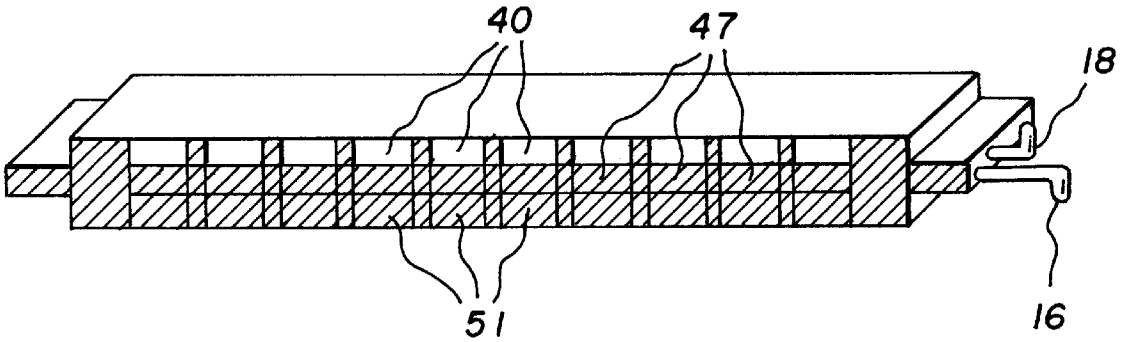
FIG. 5 is a view of the harmonica with three diatonic reeds showing a third slider configuration, where the second button is in the depressed condition.

FIGS. 3–5 show and describe the three proposed configurations for the buttons. These figures are just to give one proposed possible method of covering and uncovering the harps, other means are possible and are included as being in the scope of this applications. In this embodiment, through the actuation of the buttons, the first sliding horizontal blocking member 46 or the second sliding horizontal blocking member 48 selectively either block or open reeds.

Referring now specifically to FIG. 3, a first configuration is shown, where the first button 16 and the second button 18 are both disengaged. In this configuration, both first slider 46 and second slider 48 are engaged in blocking blocking top reed 40 and lower reed 44 respectively. This is due to the fact that the first slider 46 first reed blocking means 45 is in the blocking position and the second slider third reed blocking means 51 is in the blocking position. Air may pass through the center reed 42, since first slider 46 second reed blocking means 47 and second slider 48 second reed blocking means 49 are in the non-blocking position.

FIG. 4 shows a second configuration, where the first button 16 is engaged, and the second button 18 is disengaged. When first button 16 is depressed, second slider 48 moves to the left by one unit. This movement of the second slider 48 opens the third harp 44 by placing the second slider 48 third harp blocking means 51 to the unblocked position and closes the second slider 48 second harp blocking means 49 to the blocked position. The first slider 46 continues to block the first harp 40 by the first slider 46 first harp blocking means 45 remaining in the blocked position. Also, the first slider 46 second harp blocking means 47 remains in the unblocked position, however, second harp 42 remains blocked due to the second slider 48 second harp blocking means 49 being in the blocked position. In this configuration, first slider 46 and second slider 48 are engaged blocking harp 40 and center reed 42 respectively. Air may pass through bottom reed 44 and sound will be generated therefrom.

FIG. 5 shows a third configuration, where the second button 18 is engaged, and the first button 16 is disengaged. When the second button 18 is depressed, first slider 46 moves to the left by one unit. This movement of the first slider 46 opens the first harp 40 by placing the first slider 46 first harp blocking means 45 to the unblocked position and placing the first slider 46 second harp blocking means 47 to the blocked position. The second slider 48 continues to block the third harp 44 by the second slider 48 third harp blocking means 51 remaining in the blocked position. Also, second slider 48 second harp blocking means 49 remains in the unblocked position, however, second harp 42 remains blocked due to the first slider 46 second harp blocking means 47 being in the blocked position. In this configuration, first slider 46 and second slider 48 are engaged in blocking second reed 42 and third reed 44 respectively. Air may pass through the top reed 40 and sound will be generated therefrom.

It is further proposed that the first button 16 and the second button 18 may not be simultaneously actuated, rather, through action of engaging one of the buttons, if the other button is engaged, the other of the buttons is automatically disengaged, with the subsequent movement to the right of the associated horizontal sliding mechanism taking place. Also, by the selective engagement of the first button 16, the second button 18 is automatically disengaged, with the subsequent movement of the horizontal sliding mechanism taking place. It is to be understood that a similar action will take place when the second button 18 is actuated. The first slider 46 and the second slider 48 may be masks with apertures present, the apertures permitting air to pass and the mask acting as the aforementioned reed blocking means. A central plate would be required in such an embodiment with a plurality of apertures located therein, one for every note in every reed. By sliding the masks over the central plate, only one reed at a time would be available for play.

Figure 6:
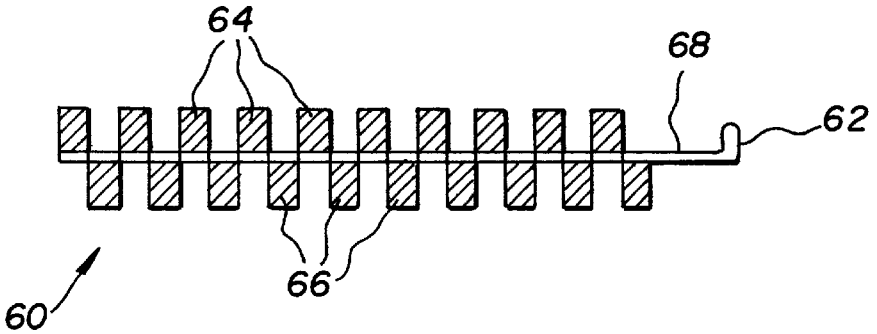
FIG. 6 is a view of a slider employed in the harmonica.

FIG. 6 shows a proposed horizontal slider 60. A button 62 is provided which is connected with the slider 60. An upwardly oriented reed blocking means 64 and a downwardly oriented reed blocking means 66 are provided on a central element 68. The upwardly oriented reed blocking means 64 and the downwardly oriented reed blocking means 66 are staggered in such a fashion as to not be vertically coincident as shown.

Figure 7:
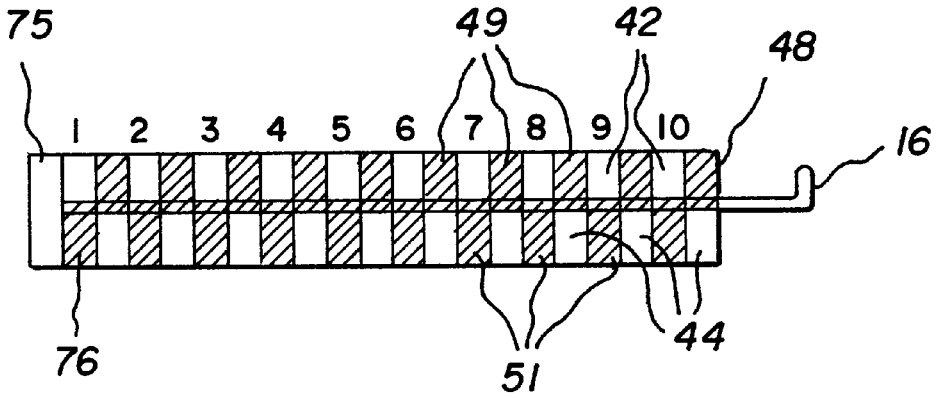
FIG. 7 is a view of the second slider and the second reed and third reed.

FIG. 7 shows the first slider 48 in the neutral position, without the first button 16 being displaced. Element 75 is a recess which is provided to accommodate the left most element 76 of the first slider 48 downwardly oriented, third reed blocking means 51 when the first button 16 is engaged. Note the second reed 42 and third reed 44 as well as upwardly oriented, second reed blocking means 49.

Figure 8:
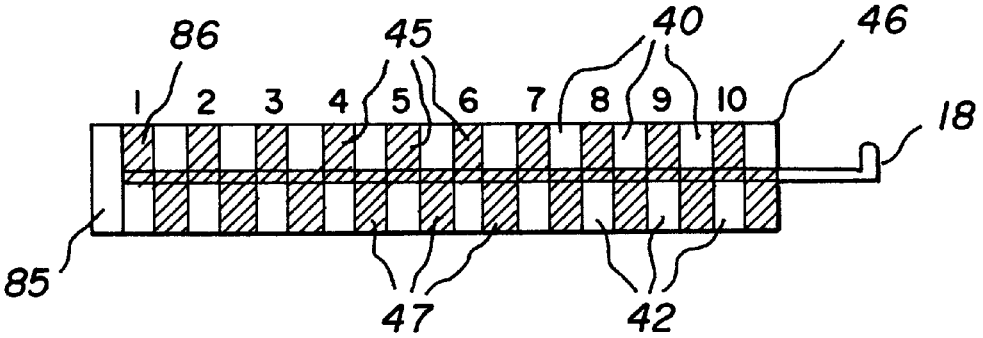
FIG. 8 is a view of the first slider and the first reed and second reed.

FIG. 8 shows the second slider 46 in the neutral position, without the second button 18 being displaced. Element 85 is a recess which is provided to accommodate the left most element 86 of the second slider 46 upwardly oriented, first reed blocking means 45 when the second button 18 is engaged. Note first reed 40, second reed 42 and downwardly oriented, second reed blocking means 47.

Figure 9:
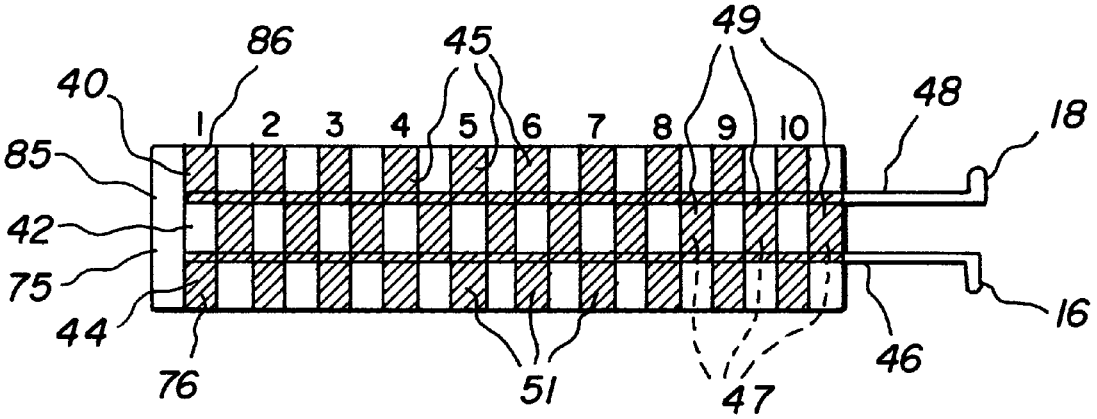
FIG. 9 is a view of the first slider, second slider, first reed, second reed and third reed.

FIG. 9 shows the first slider 46 with the second slider 48 with the first reed 40 blocked, the third reed 44 blocked and the second reed 42 unblocked. Note recess 75 and recess 85 form one large recess. All of the other elements have been previously described in the discussion of the previous figures.

Any of a variety of mechanisms may be employed to cause the elongated horizontal members to displace to block or unblock air passages in the instant harmonica. These include, but are not limited to, springs, mechanical stops, upwardly oriented paddles, downwardly oriented paddles, masks with apertures or other devices.

It is also to be understood that the button-sliding mechanism configuration, as disclosed heretofore, may have a different configuration. For instance, in another embodiment, by actuation of the first button 16, the center reed 42 or top reed 40 may remain open to permit that reed 42 to generate sound. Any order of actuation is possible by the arrangement of the horizontal blocking mechanism blocking means.

It is apparent from the above that the present invention accomplishes all of the objectives set forth by providing a harmonica with three diatonic reeds which are vertically aligned in a single housing including two sliders which will selectively block two of the diatonic reeds at all times, permitting the playing of the unblocked diatonic reed.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical embodiment of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A harmonica, said harmonica consisting:

a housing, said housing including three diatonic harps located therein, said housing having a mouthpiece to permit air to be blown therethrough, said mouthpiece in communication with said three diatonic harps, said housing further having an air exit to permit air and sound to exit, said housing further including two air blocking means, said two air blocking means selectively blocking air passage through said three diatonic harps, wherein two of said three diatonic harps are always in the blocked condition, permitting air to pass through and generate sound through only one of said three diatonic harps at any one time.

2. A harmonica as claimed in claim 1 wherein said two air blocking means are individually movable between a first position to a second position through actuation of one of two buttons, said buttons located on the exterior of said housing.

3. A harmonica as claimed in claim 2 wherein said two buttons include a first button having an engaged or disengaged position and a second button having an engaged and disengaged position.

4. A harmonica as claimed in claim 3 wherein said three diatonic harps include a first diatonic harp, a second diatonic harp and a third diatonic harp, said three diatonic harps located in vertical relation with each other, with said first diatonic harp being on top, said second diatonic harp being in the middle and said third diatonic harp being on the bottom.

5. A harmonica as claimed in claim 4 wherein when said first button is disengaged, and when said second button is disengaged, said second diatonic harp is in an unblocked position, and said first diatonic harp and said third diatonic harp are in a blocked position.

6. A harmonica as claimed in claim 5 wherein when said first button is engaged, and when said second button is disengaged, said third diatonic harp is in an unblocked position, and said first diatonic harp and said second diatonic harp are in a blocked position.

7. A harmonica as claimed in claim 5 wherein when said first button is disengaged, and when said second button is engaged, said first diatonic harp is in an unblocked position, and said second diatonic harp and said third diatonic harp are in a blocked position.

8. A harmonica as claimed in claim 7 wherein said first diatonic reed is chosen to be in the key of G, said second diatonic reed is chosen to be in the key of D and said third diatonic reed is chosen to be in the key of A.

9. A harmonica, said harmonica consisting:

a housing, said housing including a first diatonic harp, a second diatonic harp and a third diatonic harp located therein, said first diatonic harp stacked atop said second diatonic harp which is stacked atop said third diatonic harp, said housing having a mouthpiece to permit air to be blown therethrough, said mouthpiece in communication with said first diatonic harp, said second diatonic harp, and said third diatonic harp, said housing further having an air exit to permit air and sound to exit, said housing further including a first air blocking means and a second air blocking means, said first air blocking means selectively blocking a first air passage through said first diatonic harp and a second air passage through said second diatonic harp, said second air blocking means selectively blocking said second air passage through said second diatonic harp, and a third air passage through said third diatonic harp, whereby any two of said first diatonic harp, said second diatonic harp and said third diatonic harp are always in the blocked condition, permitting air to pass through and generate sound through the remaining unblocked diatonic harp.

10. A harmonica as claimed in claim 9 including a first button having an engaged or disengaged position and a second button having an engaged and disengaged position.

11. A harmonica as claimed in claim 10 wherein when said first button is disengaged, and when said second button is disengaged, said second diatonic harp is in an unblocked position, and said first diatonic harp and said third diatonic harp are in a blocked position.

12. A harmonica as claimed in claim 10 wherein when said first button is engaged, and when said second button is disengaged, said third diatonic harp is in an unblocked position, and said first diatonic harp and said second diatonic harp are in a blocked position.

13. A harmonica as claimed in claim 10 wherein when said first button is disengaged, and when said second button is engaged, said first diatonic harp is in an unblocked position, and said second diatonic harp and said third diatonic harp are in a blocked position.

14. A harmonica as claimed in claim 13 wherein said first diatonic reed is chosen to be in the key of G, said second diatonic reed is chosen to be in the key of D and said third diatonic reed is chosen to be in the key of A.

* * * * *